US011073252B2

(12) United States Patent
Yang et al.

(10) Patent No.: US 11,073,252 B2
(45) Date of Patent: Jul. 27, 2021

(54) LIGHT BULB

(71) Applicant: XIAMEN ECO LIGHTING CO. LTD., Xiamen (CN)

(72) Inventors: xiao ming Yang, Xiamen (CN); de juan Liang, Xiamen (CN); yin yu Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/365,659

(22) Filed: Mar. 26, 2019

(65) Prior Publication Data

US 2020/0309329 A1 Oct. 1, 2020

(51) Int. Cl.

| | |
|---|---|
| ***F21K 9/66*** | (2016.01) |
| ***F21K 9/233*** | (2016.01) |
| ***F21K 9/238*** | (2016.01) |
| ***F21V 17/04*** | (2006.01) |
| ***F21V 3/06*** | (2018.01) |
| ***F21V 23/00*** | (2015.01) |
| ***F21V 19/00*** | (2006.01) |

(Continued)

(52) U.S. Cl.

CPC ..... *F21K 9/66* (2016.08); *F21K 9/233* (2016.08); *F21K 9/235* (2016.08); *F21K 9/238* (2016.08); *F21K 9/69* (2016.08); *F21V 3/0615* (2018.02); *F21V 5/04* (2013.01); *F21V 17/04* (2013.01); *F21V 19/0055* (2013.01); *F21V 23/006* (2013.01); *F21Y 2113/17* (2016.08); *F21Y 2115/10* (2016.08)

(58) Field of Classification Search

CPC . F21K 9/66; F21K 9/233; F21K 9/238; F21K 9/235; F21K 9/69; F21V 3/0615; F21V 5/04; F21V 17/04; F21V 19/0055; F21V 23/006; F21Y 2113/17; F21Y 2115/10

See application file for complete search history.

(56) References Cited

U.S. PATENT DOCUMENTS

2010/0097806 A1* 4/2010 Kao ..... F21K 9/238 362/253
2011/0317428 A1* 12/2011 Paik ..... F21V 19/0055 362/294

(Continued)

*Primary Examiner* — Bao Q Truong
(74) *Attorney, Agent, or Firm* — Chun-Ming Shih; Lanway IPR Services

(57) ABSTRACT

A light bulb includes a housing, an illuminating component, a driving circuit board, a light transmitting component and a lens. The housing has a circumferential opening and a cavity chamber therein. The illuminating component is disposed within the cavity chamber. The driving circuit board is disposed inside the cavity chamber. The driving circuit board is also electrically coupled to the illuminating component. In addition, the driving circuit board drives the illuminating component while being powered up. The light transmitting component is disposed within the cavity chamber and affixed to the illuminating component. The light transmitting component includes a plurality of transmitting microstructures on its surface that uniformly distribute lights emitted from the illuminating component along an axial direction of the light bulb. The lens is disposed within the cavity chamber. The lens also focuses the uniformly distributed lights on a predetermined range along the axial direction of the light bulb.

13 Claims, 6 Drawing Sheets

(51) Int. Cl.

| | |
|---|---|
| ***F21V 5/04*** | (2006.01) |
| ***F21K 9/69*** | (2016.01) |
| ***F21K 9/235*** | (2016.01) |
| *F21Y 113/17* | (2016.01) |
| *F21Y 115/10* | (2016.01) |

(56) References Cited

U.S. PATENT DOCUMENTS

| | | | | |
|---|---|---|---|---|
| 2012/0218748 | A1* | 8/2012 | Conrad | F21K 9/23 362/230 |
| 2013/0221829 | A1* | 8/2013 | Kitagawa | F21V 5/008 313/110 |
| 2017/0002989 | A1* | 1/2017 | Gorlinskiy | F21V 5/002 |
| 2017/0045214 | A1* | 2/2017 | Johnson | F21V 3/061 |
| 2017/0146199 | A1* | 5/2017 | Weng | F21V 29/70 |
| 2018/0180272 | A1* | 6/2018 | Zheng | F21K 9/233 |
| 2018/0245746 | A1* | 8/2018 | Feit | F21V 29/70 |

* cited by examiner

LIGHT BULB

BACKGROUND

1. Field of the Invention

The present invention relates to a light bulb, and particularly relates to a light bulb capable of uniformly distributing its luminance.

2. Description of the Prior Art

A conventional light bulb, e.g. a light-emitting diode (LED) light bulb, is used for providing sufficient luminance. However, the conventional light bulb is also requested to acquire more additional functions, such as providing dynamically adjustable luminance and/or color temperature. Such additional functions are difficult to achieve because the conventional light bulbs have less flexibility in design of adjustable luminance and/or color temperature. More specifically, switching of different color temperature requires different types of light bulbs and an appropriate arrangement of these light bulbs. Such arrangement of different types of light bulbs is inevitably biased. In this way, generated spotlights must have a dim shape and/or non-uniform color graduals.

SUMMARY OF INVENTION

For neutralizing the conventional light bulb's defect of uniformly illumination, the present invention discloses certain types of light bulbs.

In a first embodiment, the present invention discloses a light bulb, which includes a housing, an illuminating component, a driving circuit board, a light transmitting component and a lens. The housing has a circumferential opening and a cavity chamber therein. The illuminating component is disposed within the cavity chamber. The driving circuit board is disposed inside the cavity chamber. The driving circuit board is also electrically coupled to the illuminating component. In addition, the driving circuit board drives the illuminating component while being powered up. The light transmitting component is disposed within the cavity chamber and affixed to the illuminating component. The light transmitting component includes a plurality of transmitting microstructures on its surface that uniformly distribute lights emitted from the illuminating component along an axial direction of the light bulb. The lens is disposed within the cavity chamber. The lens also focuses the uniformly distributed lights on a predetermined range along the axial direction of the light bulb.

In one example, the illuminating component includes a plurality of light emitting diodes that emit at least two different color temperatures.

In one example, the light transmitting component is arc-shaped.

In one example, the light transmitting component further includes a first engaging element that faces the illuminating component. The illuminating component further includes a second engaging element that faces the light transmitting component. The first engaging element is detachably engaged with the second engaging element, such that the light emitting component engages with the illuminating component.

In one example, the light transmitting component includes an opal glass diffusing plate.

In one example, the disclosed light bulb further includes a bulb base, which is disposed within the cavity chamber for supporting the illuminating component.

In one example, the bulb base includes a circumferential base plate and a sidewall. The circumferential base plate is disposed between the illuminating component and the driving circuit board. The circumferential base plate matches the circumferential opening of the housing, such that the base plate is capable of fitting the cavity chamber. The sidewall is coupled to the circumferential base plate. The sidewall also surrounds the illuminating component. The illuminating component and the driving circuit board are disposed in opposite sides of the base plate.

In one example, the illuminating component further includes a power socket. The base plate further includes a driving through hole. The driving circuit board further includes a conductive connector. The conductive connector passes through the driving through hole and reaches the power socket for detachably engaging both the illuminating component and the driving circuit board to the base plate. The driving circuit board further drives the illuminating component via an electrical connection between the conductive connector of the driving circuit board and the power socket of the illuminating component.

In one example, the light bulb further includes a screw. The illuminating component further includes a screw through hole that allows the screw to screw through. The housing further includes a screw hole within the cavity chamber for receiving the screw. The screw screws through the screw through hole and reaches the screw hole for detachably engaging the illuminating component to the housing.

In one example, the illuminating component includes a surface mounted light emitting diode (SMD LED) module.

In one example, the housing further includes a socket. The socket is disposed at the surface of the housing and electrically coupled to the driving circuit board. The socket also powers up the driving circuit board while being electrically coupled to an external power source.

In a second embodiment, the present invention further discloses a light bulb that includes a housing, an illuminating component, a driving circuit board, a lens and a light transmitting component. The housing has a circumferential opening and a cavity chamber therein. The illuminating component is disposed within the cavity chamber. The driving circuit board is disposed inside the cavity chamber. The driving circuit board is also electrically coupled to the illuminating component. In addition, the driving circuit board drives the illuminating component while being powered up. The lens is disposed within the cavity chamber. The lens also focuses lights emitted by the illuminating component on a predetermined range along an axial direction of the light bulb. The light transmitting component is disposed at the circumferential opening of the housing to cover the lens. The light transmitting component includes a plurality of light transmitting microstructures on its surface that uniformly distribute the focused lights from the lens along the axial direction of the light bulb.

In one example, the light transmitting component includes a light guide plate.

In one example, each of the plurality of light emitting microstructures is hexagon-shaped.

In one example, the light transmitting component is circular-shaped.

In one example, the illuminating component includes a plurality of light emitting diodes, e.g., a plurality of arranged LEDs 210, which emit at least two different color temperatures.

In one example, the light transmitting component further includes a first engaging element that faces the lens. The lens further includes a second engaging element that faces the light transmitting component. The first engaging element is detachably engaged with the second engaging element, such that the light emitting component engages with the lens.

In one example, the light transmitting component includes an opal glass diffusing plate.

In one example, the light bulb further includes a bulb base, which is disposed within the cavity chamber for supporting the illuminating component.

In one example, the bulb base includes a circumferential base plate and a sidewall. The circumferential base plate is disposed between the illuminating component and the driving circuit board. The circumferential base plate matches the circumferential opening of the housing such that the base plate is capable of fitting the cavity chamber. The sidewall is coupled to the circumferential base plate. The sidewall also surrounds the illuminating component. The illuminating component and the driving circuit board are disposed in opposite sides of the base plate.

In one example, the illuminating component further includes a power socket. The base plate further includes a driving through hole. The driving circuit board further includes a conductive connector. The conductive connector passes through the first through hole and reaches the power socket for detachably engaging both the illuminating component and the driving circuit board to the base plate. The driving circuit board further drives the illuminating component via an electrical connection between the conductive connector of the driving circuit board and the power socket of the illuminating component.

In one example, the light bulb further includes a screw. The illuminating component further includes a screw through hole that allows the screw to screw through. The housing further includes a screw hole within the cavity chamber for receiving the screw. The screw screws through the screw through hole and to reach the screw hole for detachably engaging the illuminating component to the housing.

In one example, the illuminating component includes a surface mounted light emitting diode (SMD LED) module.

In one example, the housing further includes a socket. The socket is disposed at the surface of the housing. The socket is also electrically coupled to the driving circuit board. In addition, the socket powers up the driving circuit board while being electrically coupled to an external power source.

These and other objectives of the present invention will no doubt become obvious to those of ordinary skill in the art after reading the following detailed description of the preferred embodiment that is illustrated in the various figures and drawings.

DETAILED DESCRIPTION

As mentioned, the present invention discloses certain light bulbs for neutralizing biased illuminance and capable of providing various types of color temperatures in a more uniform manner. Note that the disclosed light bulb may include LED light bulbs or other types of light bulbs.

Figure 1:
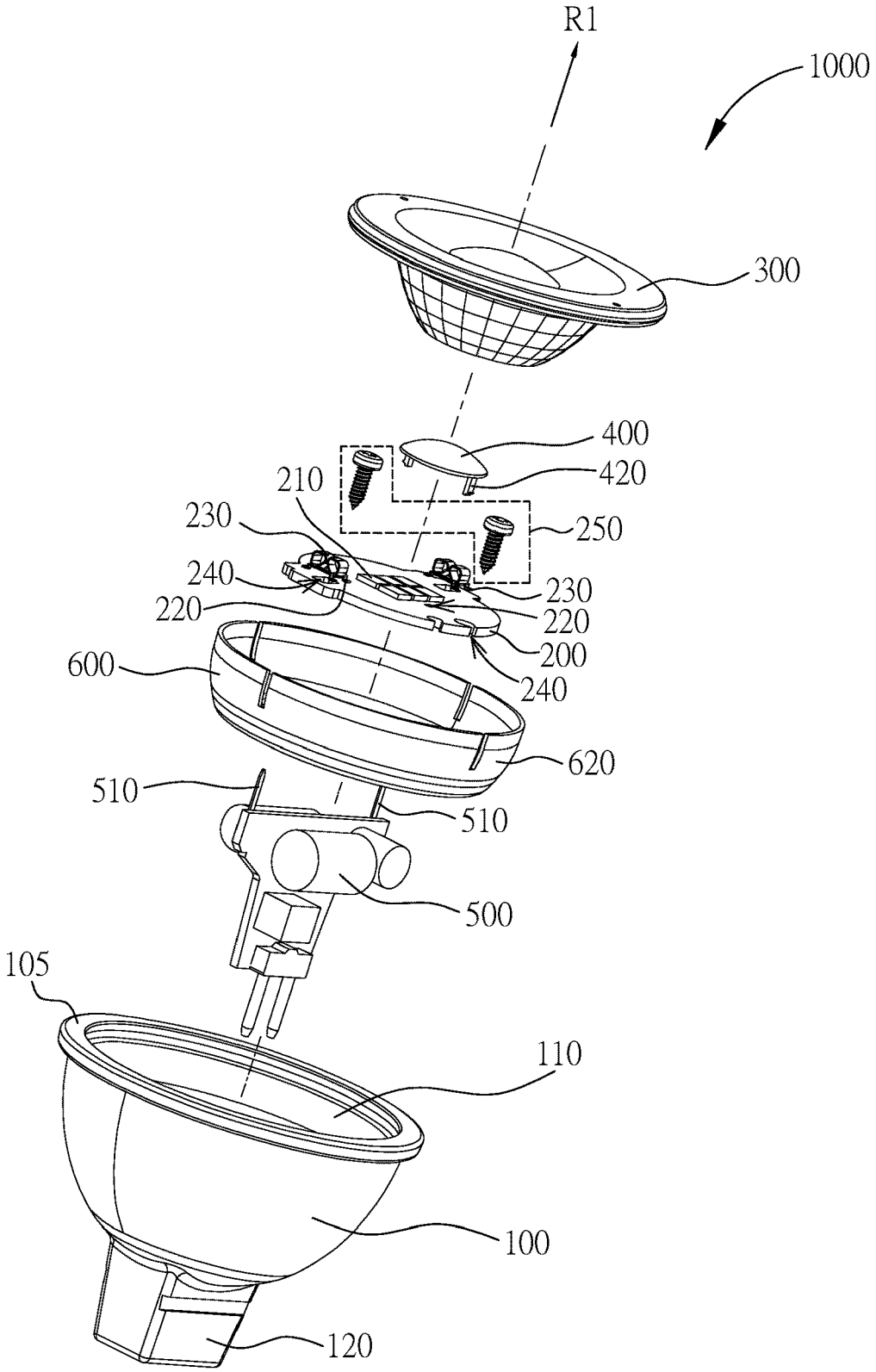
FIG. 1 illustrates a split view of a light bulb according to a first embodiment of the present invention.
Figure 2:
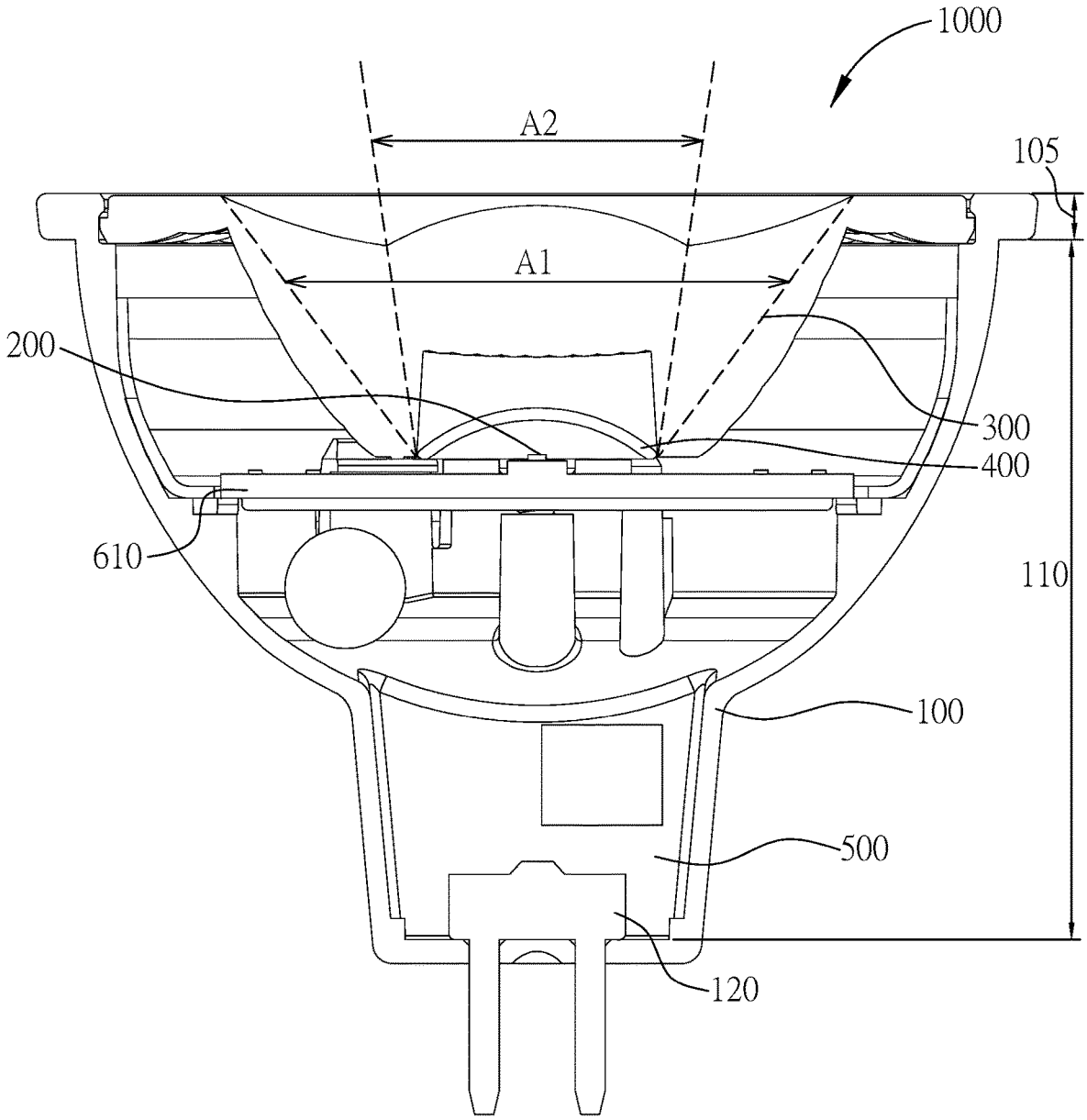
FIG. 2 illustrates a lateral perspective view of the light bulb shown in FIG. 1.

FIG. 1 illustrates a split view of a light bulb 1000 according to a first embodiment of the present invention. Also, FIG. 2 illustrates a lateral perspective view of the light bulb 1000 shown in FIG. 1.

The light bulb 1000 includes at least a housing 100, an illuminating component 200, a driving circuit board 500, a light transmitting component 400 and a lens 300.

The housing 100 has a circumferential opening 105 and a cavity chamber 110, which is located inside the opening 105. The illuminating component 200 is disposed within the cavity chamber 110.

The driving circuit board 500 is disposed inside the cavity chamber 105. Also, the driving circuit board 500 is electrically coupled to the illuminating component 200, for example, at a bottom side of the illuminating component 200, such that the driving circuit board 500 is capable of driving the illuminating component 200 while the driving circuit board 500 is powered up via an external power source.

The light transmitting component 400 is disposed within the cavity chamber 110. Also, the light transmitting component 400 is affixed to the illuminating component 200, for example, at a top side of the illuminating component 200. In some examples, the light transmitting component 400 includes multiple transmitting microstructures on its surface. Also, the transmitting microstructures are used for uniformly distributing lights emitted from the illuminating component 200 along an axial direction R1 of the light bulb 1000, for example, by diffraction, refraction, or scattering of lights. With the aid of the transmitting microstructures, lights emitted from the light transmitting component 400 can be better focused on a certain area below the opening 105, for example, an area A1 shown in FIG. 2.

The lens 300 is disposed within the cavity chamber 110. Similar as the light transmitting component 400, the lens 300 again focuses the uniformly distributed lights emitted from the light transmitting component 400 on a predetermined range A2 along the axial direction R1 of the light bulb 1000. Because of the uniformly distributed lights from the light transmitting component 400, light spots emitted from the lens 300 can form a clearer contour. More particularly, when multiple light bulbs 1000 are well arranged in a designed manner, the generated light spots can be more easily controlled to generate desired luminance on desired regions without dim contours.

In one example, the illuminating component 200 includes multiple light emitting diodes (LEDs) that emit at least two different color temperatures. In this way, for the purpose of presenting a specific color temperature, multiple light bulbs 1000 can be arranged by design to generate the desired color temperature without dim contours. Also, in another example, the illuminating component 200 is a surface mounted light emitting diode (SMD LED) module, which has a broader angle and range of illuminating, such that the light bulb 1000 may emit a broader range of illuminance.

In one example, the light transmitting component 400 is arc-shaped. Such that the light transmitting component 400 is capable of better focusing lights from the illuminating component 200 on a desired region, for example, the region A1 shown in FIG. 2.

In one example, the light transmitting component 400 and the illuminating component 200 are specifically designed to better engage with each other in a detachable manner. For example, the light transmitting component 400 further includes at least one first engaging element 420 that faces the illuminating component 200. Also, the illuminating component 200 further includes at least one second engaging element 220 that faces the light transmitting component 400 and respectively corresponds to each of the at least one first engaging element 420. The light transmitting component 400 can be detachably engaged with the illuminating component 200 by detachably engaging the at least one first engaging element 420 with the at least one second engaging element 210.

In one example, the light transmitting component 400 may be implemented using an opal glass diffusing plate for efficiently distributing lights from the illuminating component 200 in a uniform manner.

In one example, the light bulb 1000 may further include a bulb base 600, which is disposed within the cavity chamber 110 for better supporting the illuminating component 200. More specifically, the bulb base 600 may include a circumferential base plate 610 and a sidewall 620. The circumferential base plate 610 is sandwiched between the illuminating component 200 and the driving circuit board 500. For example, as shown in FIGS. 1-2, the illuminating component 200 is disposed at an upper side of the circumferential base plate 610, whereas the driving circuit board 500 is disposed at a lower side of the circumferential base plate 610. For gaining support from the housing 100, the circumferential base plate 610 matches the circumferential opening 105 of the housing 100 in shape and size, such that the base plate 600 is capable of fitting the cavity chamber 110. Moreover, the sidewall 620 is coupled to the circumferential base plate 610. The sidewall 620 also surrounds the illuminating component 200 for protection. For driving the illuminating component 200, the driving circuit board 500 is electrically coupled to the illuminating component 200 for powering up and control when the driving circuit board 500 is charged using an external power source. Specifically, in one example, the illuminating component 200 further includes at least one power socket 230 for powering up the illuminating component 200. The base plate 610 may further include at least one driving through hole (not illustrated) that respectively corresponds to the at least one power socket 230. And the driving circuit board 500 may further include at least one conductive connector 510, which is capable of passing through the at least one driving through hole and reaching the at least one power socket 230 in turn for detachably engaging both the illuminating component 200 and the driving circuit board 500 to the base plate 610. On top of that, the housing 100 may further include a socket 120 at its surface, as shown in FIG. 1. The socket 120 is also electrically coupled to the driving circuit board 500 within the cavity chamber 110. Such that when the socket 120 is electrically coupled to an external power source, the socket 120 can charge the driving circuit board 500. In turn, the driving circuit board 500 is capable of driving the illuminating component 200 via an electrical connection between the conductive connector 510 of the driving circuit board 500 and the at least one power socket 230 of the illuminating component 200.

In one example, the illuminating component 200 may be further screwed to the housing 100 for better engagement, for example, with the aid of at least one screw 250 of the light bulb 1000. The illuminating component 200 further includes at least one screw through hole 240 that allows the at least one screw 250 to screw through. The housing 100 further includes a screw hole (not shown) within the cavity chamber 110 for receiving the at least one screw 250. In this way, the at least one screw 250 screws through the screw through hole 240 and reaches the screw hole for detachably engaging the illuminating component 200 to the housing 1000. According to a second embodiment, the present invention further discloses a light bulb 2000. The light bulb 2000 shares most features as those of the light bulb 1000, except for the position of the light transmitting component 400. More specifically, the light bulb 2000 removes the light transmitting component 400 between the lens 300 and the illuminating component 200.

Instead, the light bulb 2000 utilizes another transmitting component 700 and disposes it to cover the lens 300.

Figure 3:
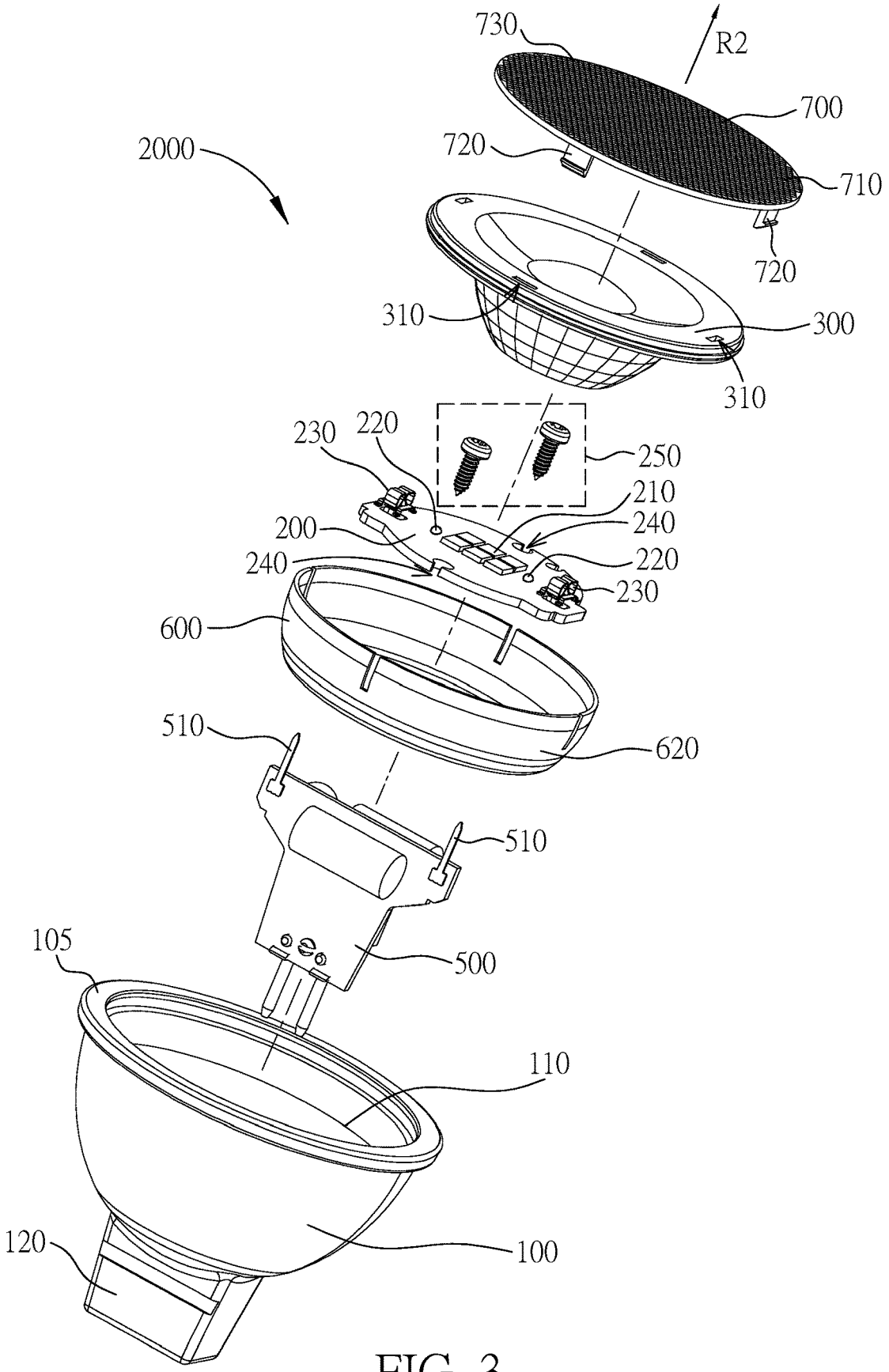
FIG. 3 illustrates a split view of a light bulb according to the second embodiment of the present invention.
Figure 4:
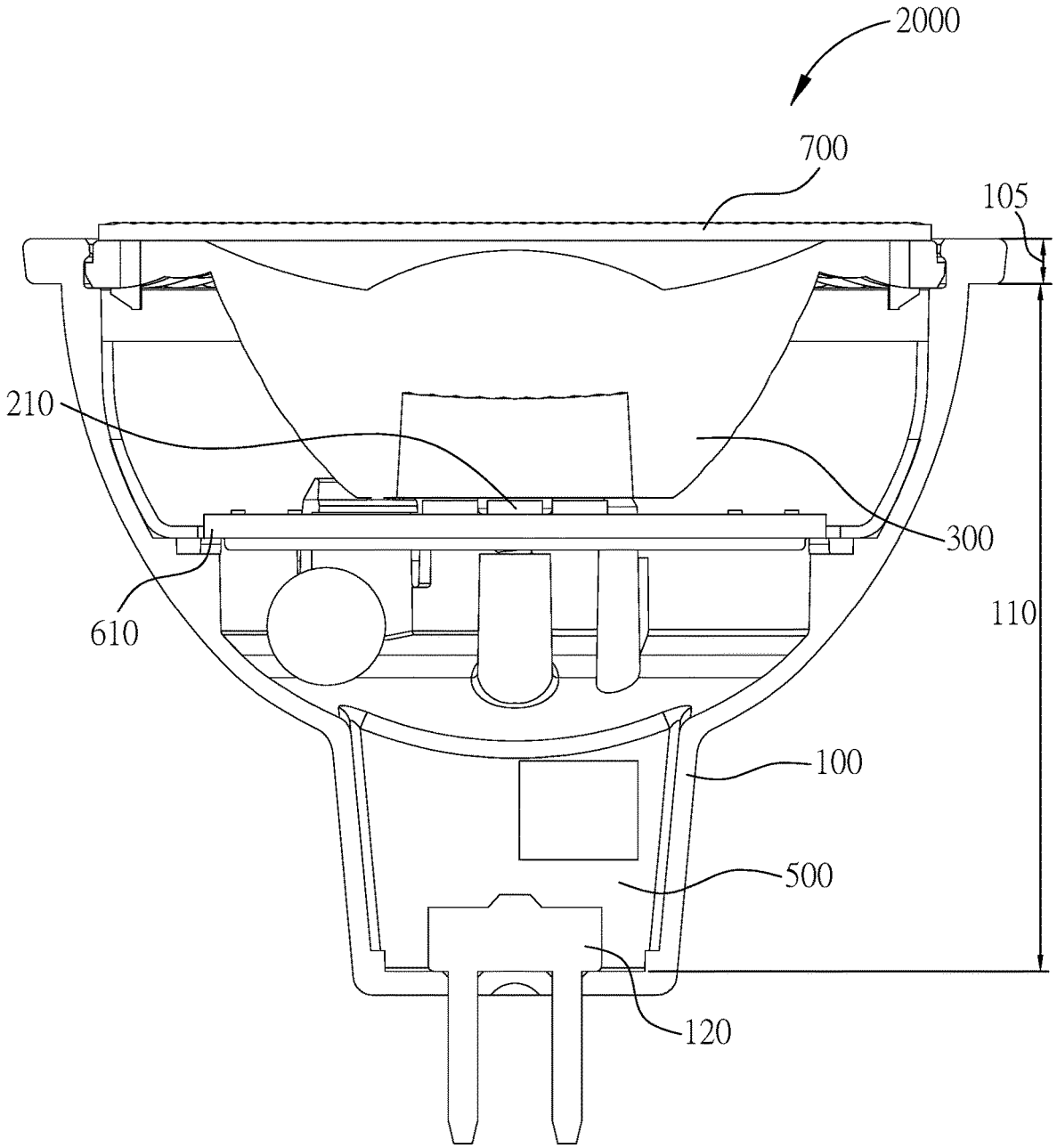
FIG. 4 illustrates a lateral perspective view of the light bulb 2000 shown in FIG. 3.

FIG. 3 illustrates a split view of the light bulb 2000 according to the second embodiment of the present invention. Also, FIG. 4 illustrates a lateral perspective view of the light bulb 2000 shown in FIG. 3.

As mentioned above, since the light bulb 2000 shares most features and/or dispositions as those of the light bulb 1000, repeated features and dispositions are skipped for brevity.

The light bulb 2000 does not include the light transmitting component 400, instead, it includes another light transmitting component 700 disposed at the circumferential opening 105 of the housing 100 to cover the lens 300. Also, the light transmitting component 700 includes multiple light transmitting microstructures 730 on its surface. The multiple light transmitting microstructures 730 uniformly distribute focused lights from the lens 300 along an axial direction R2 of the light bulb 2000.

In one example, the light transmitting component 700 is implemented using a circular-shaped plate, for example, a circular light guide plate for fitting an upper flat surface of the light transmitting component 700. The light guide plate, i.e., the light transmitting component 700, the is capable of better focusing lights from the lens 300 than a curve-surfaced lens.

Figure 5:
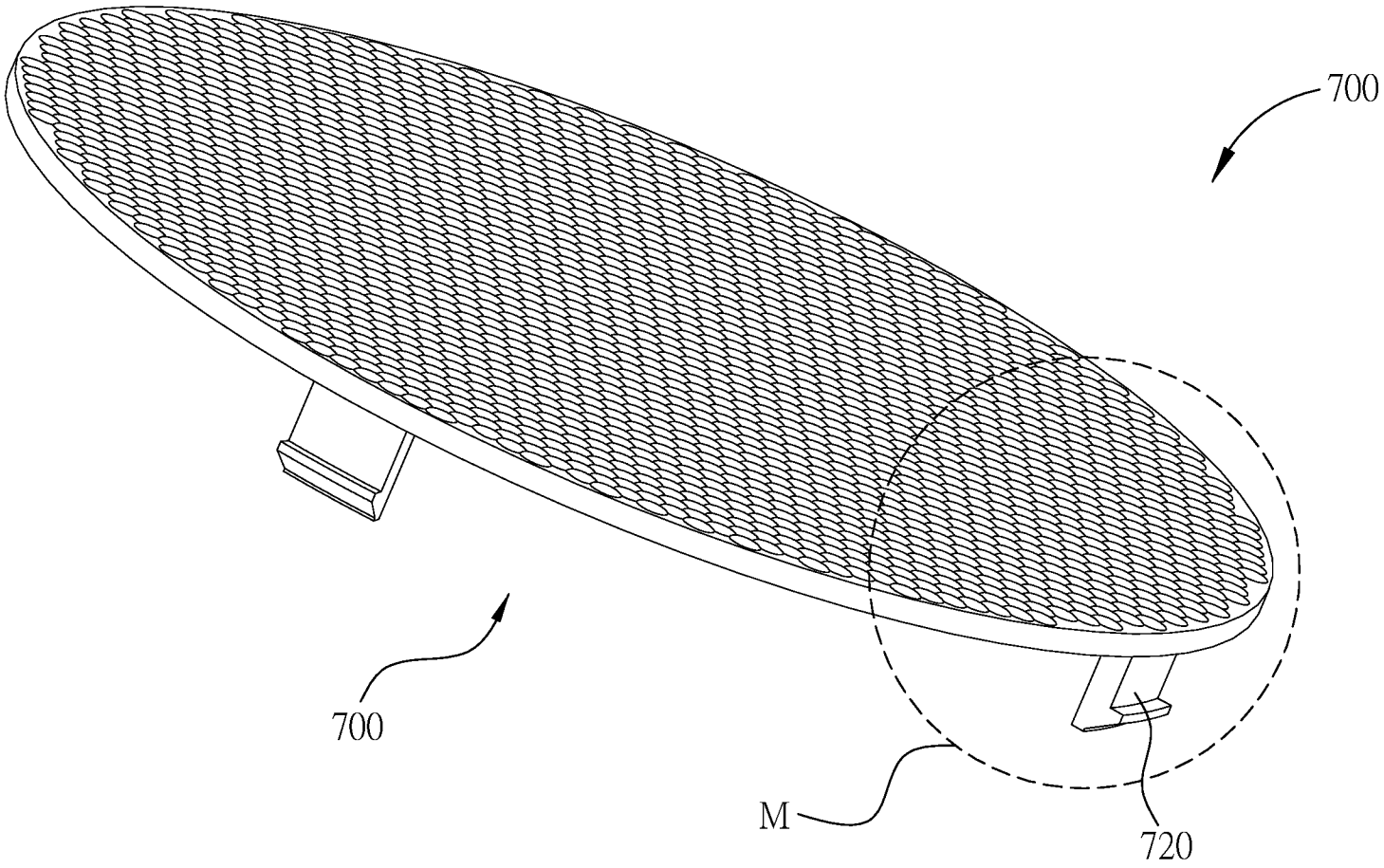
FIG. 5 illustrates the light transmitting component shown in FIG. 3 in detail according to one example.
Figure 6:
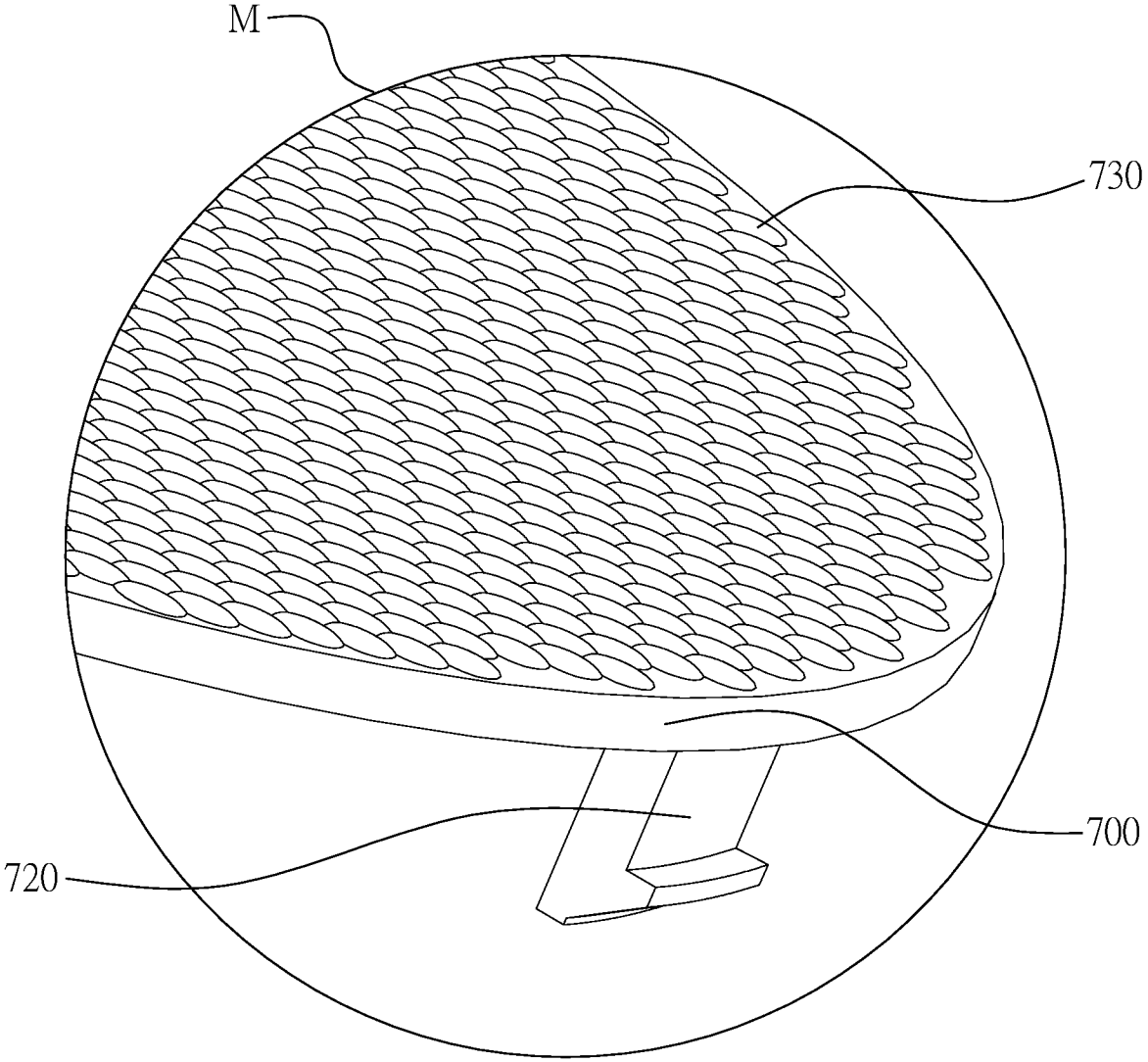
FIG. 6 illustrates part of the light transmitting component shown in FIG. 5 in more details.

FIG. 5 illustrates the light transmitting component 700 in detail according to one example. Further, FIG. 6 illustrates part of the light transmitting component 700 in more details. As shown in FIG. 5, the surface of the light transmitting component 700 is fully distributed with multiple light transmitting microstructures 730. For fitting with each other in a compact manner, as shown in a region M of FIGS. 5-6, each of the light transmitting microstructures 730 may be hexagon-shaped. However, in other examples, each of the plurality of light emitting microstructures 730 can be in other geometric shapes, as long as the geometric shape keeps each of the plurality of light emitting microstructures 730 in mutually-compact manner, for example, regular quadrilateral or octagonal.

Similarly, the light transmitting component 700 may include at least one engaging element 720. And the lens may further include at least one engaging element 310. By detachably engaging the at least one engaging element 720 to the at least one engaging element 310, the light transmitting component 700 can be detachably engaged to the lens 300 for covering the lens 300.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light bulb, comprising:

a housing, having a circumferential opening and a cavity chamber therein;

an illuminating component, disposed within the cavity chamber;

a driving circuit board, disposed inside the cavity chamber, electrically coupled to the illuminating component, and configured to drive the illuminating component while being powered up;

a lens, disposed within the cavity chamber and configured to focus lights emitted by the illuminating component on a predetermined range along an axial direction of the light bulb; and a light transmitting component, disposed at the circumferential opening of the housing to cover the lens, and the light transmitting component comprises a plurality of light transmitting microstructures on its surface that uniformly distribute the focused lights from the lens along the axial direction of the light bulb, wherein the light transmitting component further comprises a first engaging element that faces the lens;

wherein the lens further comprises a second engaging element that faces the light transmitting component; and wherein the first engaging element is detachably engaged with the second engaging element, such that the light emitting component engages with the lens.

2. The light bulb of claim 1, wherein the light transmitting component comprises a light guide plate.

3. The light bulb of claim 1, wherein each of the plurality of light emitting microstructures is hexagon-shaped.

4. The light bulb of claim 1, wherein the light transmitting component comprises a circular-shaped plate.

5. The light bulb of claim 1, wherein the illuminating component comprises a plurality of light emitting diodes that emit at least two different color temperatures.

6. The light bulb of claim 1, wherein the light transmitting component comprises an opal glass diffusing plate.

7. The light bulb of claim 1, further comprising:

a bulb base, disposed within the cavity chamber for supporting the illuminating component.

8. The light bulb of claim 7, wherein the bulb base comprises:

a circumferential base plate, disposed between the illuminating component and the driving circuit board, wherein the circumferential base plate matches the circumferential opening of the housing such that the base plate is capable of fitting the cavity chamber; and a sidewall, coupled to the circumferential base plate and configured to surround the illuminating component;

wherein the illuminating component and the driving circuit board are disposed in opposite sides of the base plate.

9. The light bulb of claim 8, wherein the illuminating component further comprises a power socket;

wherein the base plate further comprises a driving through hole;

wherein the driving circuit board further comprises a conductive connector, which is configured to pass through the driving through hole and reach the power socket for detachably engaging both the illuminating component and the driving circuit board to the base plate; and wherein the driving circuit board is further configured to drive the illuminating component via an electrical connection between the conductive connector of the driving circuit board and the power socket of the illuminating component.

10. The light bulb of claim 1, further comprising:

a screw;

wherein the illuminating component further comprises a screw through hole that allows the screw to screw through;

wherein the housing further comprises a screw hole within the cavity chamber for receiving the screw; and wherein the screw is configured to screw through the screw through hole and to reach the screw hole for detachably engaging the illuminating component to the housing.

11. The light bulb of claim 1, wherein the illuminating component comprises a surface mounted light emitting diode (SMD LED) module.

12. The light bulb of claim 1, wherein the housing further comprises a socket, which is disposed at the surface of the housing, electrically coupled to the driving circuit board, and configured to power up the driving circuit board while being electrically coupled to an external power source.

13. The light bulb of claim 1, wherein each of the plurality of light emitting microstructures is in a geometric shape that keeps each of the plurality of light emitting microstructures in mutually-compact manner.

* * * * *